US006601848B1

(12) United States Patent
Timmons, Sr.

(10) Patent No.: US 6,601,848 B1
(45) Date of Patent: Aug. 5, 2003

(54) DICE GAME

(76) Inventor: William P. Timmons, Sr., 2651Old Peachtree Rd., Dacula, GA (US) 30019

( * ) Notice: Subject to any disclaimer, the term of this patent is extended or adjusted under 35 U.S.C. 154(b) by 0 days.

(21) Appl. No.: 10/154,170

(22) Filed: May 22, 2002

(51) Int. Cl.[7] ..... A63F 9/04
(52) U.S. Cl. ..... 273/146; 273/274; 273/309
(58) Field of Search ..... 273/146, 274, 273/309, 138.1, 138.2

(56) References Cited

U.S. PATENT DOCUMENTS

| | | | | | |
|---|---|---|---|---|---|
| 4,334,685 | A | * | 6/1982 | Robbins et al. | 273/274 |
| 5,125,660 | A | | 6/1992 | Stahl | 273/146 |
| 5,456,467 | A | | 10/1995 | Hoover | 273/146 |
| 5,620,183 | A | | 4/1997 | Skratulia | 273/146 |
| 5,806,847 | A | | 9/1998 | White et al. | 273/309 |
| 5,964,463 | A | | 10/1999 | Moore, Jr. | 273/274 |
| 6,062,563 | A | * | 5/2000 | de Keller | 273/274 |
| 6,234,482 | B1 | | 5/2001 | Henderson | 273/274 |
| 6,273,423 | B1 | | 8/2001 | Promutico | 273/274 |
| 6,286,834 | B1 | | 9/2001 | Caputo | 273/274 |
| 6,305,686 | B1 | | 10/2001 | Perrie et al. | 273/146 |
| 6,336,633 | B1 | | 1/2002 | Webb | 273/274 |

* cited by examiner

*Primary Examiner*—Benjamin H. Layno
(74) *Attorney, Agent, or Firm*—Merchant & Gould, LLC

(57) ABSTRACT

A dice game is disclosed. A method of playing a dice game is also disclosed. The dice game includes three to five similarly colored dice, and a game table. The game table has a game board displaying representations of all the possible single roll dice combinations for three to five dice, and the payout odds for each of the possible single roll dice combinations.

47 Claims, 4 Drawing Sheets

DICE GAME

FIELD OF THE INVENTION

The present invention is directed to a dice game and a method of playing a dice game.

BACKGROUND OF THE INVENTION

Dice games have been around for many years. Popular dice games include, but are not limited to, "craps", baccarat, YAHTZEE™, and others.

Known dice games have one or more shortcomings. Most known dice games are either too complicated for players to understand and/or fail to provide enough excitement to keep a player's interest.

What is needed in the art is a simple dice game, which generates and maintains a player's interest, provides hours of enjoyment, and provides the potential for an exceptional reward for a winning roll of the dice.

SUMMARY OF THE INVENTION

The present invention addresses some of the difficulties and problems discussed above by the discovery of an improved dice game, which is simple to learn and play. The dice game provides a potential winner for every roll of the dice. The dice game also provides substantial rewards for winning rolls, which generates and maintains player interest in the game.

Accordingly, the present invention is directed to a new dice game. The present invention is further directed to a method of playing the new dice game.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to a dice game, which provides a high degree of excitement to one or more players, as well as, the potential for pay-outs as much as 6,000 to 1. The dice game of the present invention is simple to learn and play, unlike some popular dice games. Further, the dice game provides one or more potential winners for every roll of the dice.

The dice game of the present invention may be played in a casino similar to the game of "craps" or may be played at home in the form of a board game, such as MONOPOLY™. In other embodiments of the present invention, the dice game may be played on an electronic device, such as a video poker machine, a hand-held device similar to a GAME-BOY™ device, or any other electronic game.

Various aspects of the present invention are further described below.

I. Components of the Dice Game

The dice game of the present invention comprises one or more of the following components.

A. Dice

The dice game of the present invention may comprise from three to five dice. The dice used in the present invention may be any standard dice having six sides, and a number of markings on each side to designate a number from 1 to 6. The markings on each side of the die may be spots, dots, hearts, or any other marking.

The dice may be of any shape, size, and color. Desirably, the dice have a substantially cubed shape and a size such that up to five dice may be held in a player's hand. The color of the dice may be any color. In one embodiment of the present invention, a variety of colors may be made available to a player, so that the player can use his or her "lucky" color. Typically, the dice have an ivory color and black dots on each side of the dice.

Although conventional dice are desired in the present invention, specialty dice may also be used. Such dice may have numbers or other types of symbols on each surface of the die. Examples of numbers or symbols include, but are not limited to, English numbers, Roman numerals, and casino symbols (i.e., one to six logos or trademarks of a casino on each side of a die).

B. Dice Game Table

Figure 2:
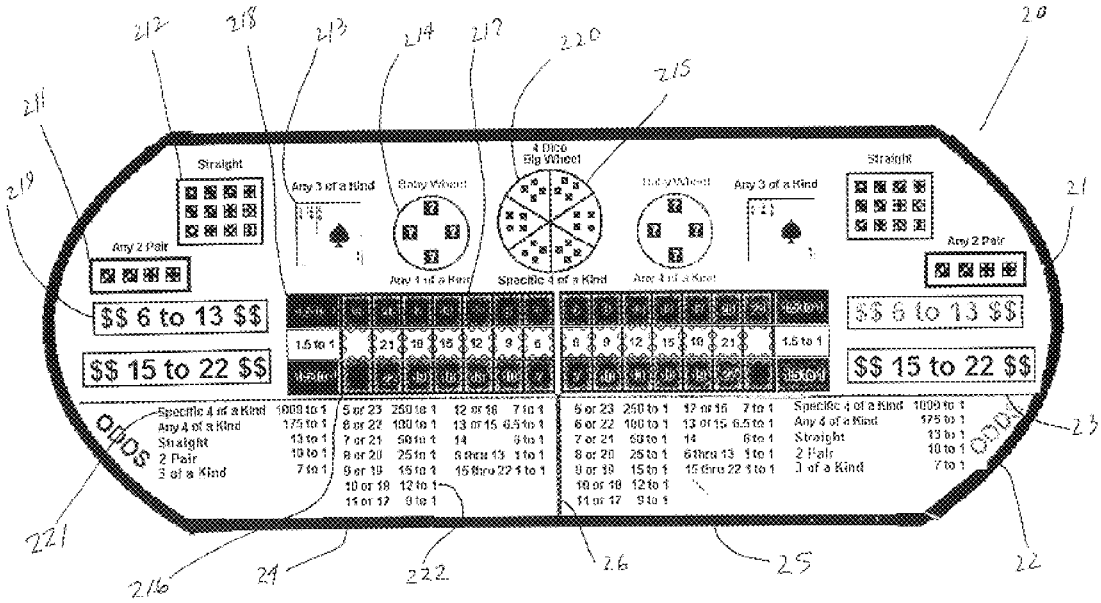
FIG. 2 depicts an exemplary table design for a dice game using 4 dice.
Figure 3:
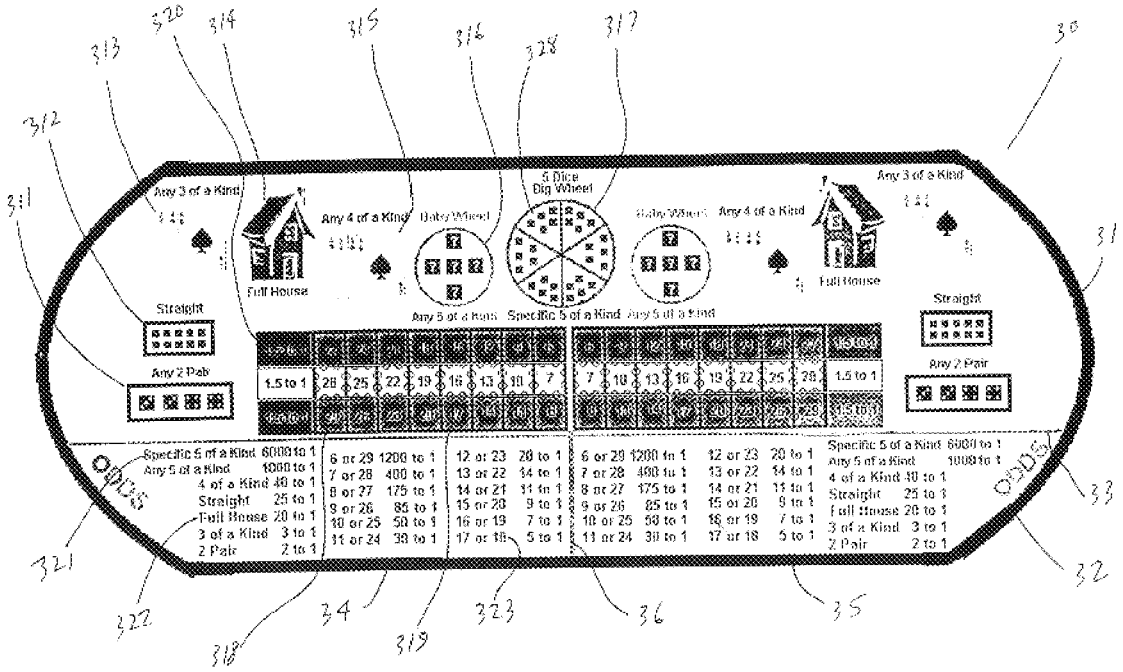
FIG. 3 depicts an exemplary table design for a dice game using 5 dice.

In one embodiment of the present invention, the dice game may be played on a game table similar to a craps table. Exemplary game tables of the present invention may have a table design such as shown in FIGS. 1–3.

Figure 1:
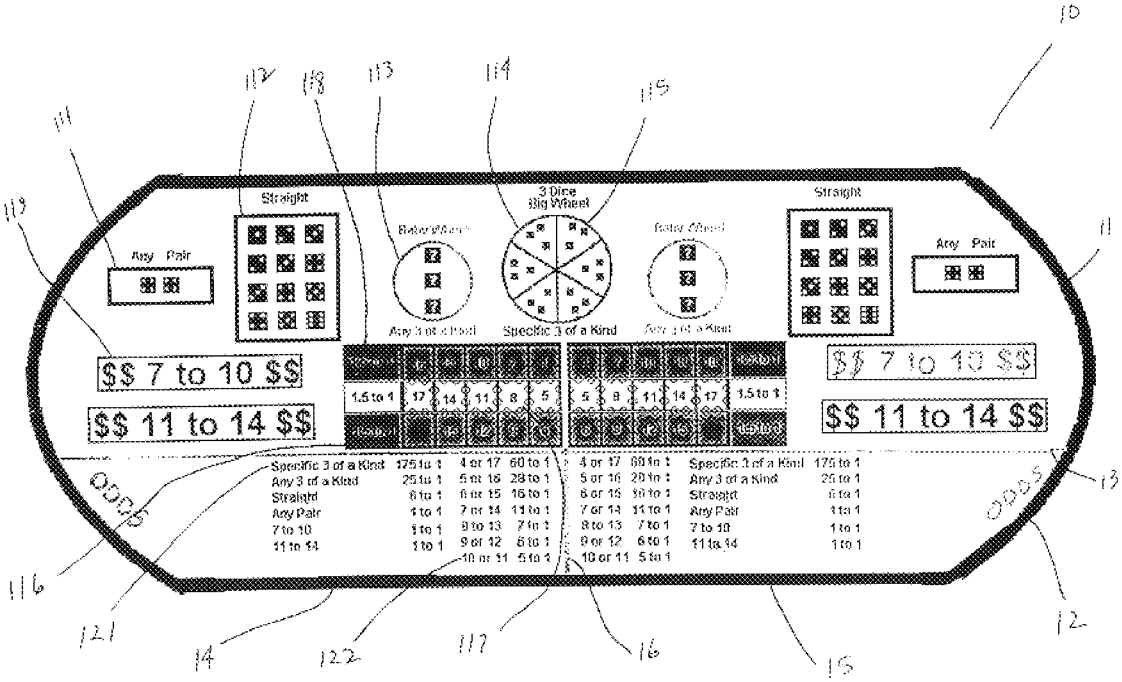
FIG. 1 depicts an exemplary table design for a dice game using 3 dice.

FIG. 1 depicts a table design suitable for use in the dice game of the present invention, wherein three dice are used to play the game. As shown in FIG. 1, game table 10 comprises an upper section 11 and a lower section 12 separated by horizontal line 13. Game table 10 also comprises two substantially similar halves 14 and 15 separated by vertical line 16. Left half 14 and right half 15 are substantially similar to one another, almost mirror images of one another, except for the "3 Dice Big Wheel" circle 114, which is bisected by line 16.

Upper section 11 displays possible rolls (i.e., combinations of the three dice) in the dice game, while lower section 12 displays some of the "pay-out odds" for a winning roll. As used herein, the term "pay-out odds" is used to describe a ratio of (a) the amount of reward paid to a player for a winning roll to (b) a given bet. For example, if the pay-out odds are "175 to 1" and a player's bet is $ 1.00, the amount of the reward paid to the player for a winning roll is $175.00.

Within upper section 11, individual bets (not shown) may be placed in one or more of the following areas corresponding to a given bet: the "Any Pair" rectangle 111; the "Straight" rectangle 112; the "Baby Wheel" circle 113 for any 3-of-a-kind bet; and one or more pie sections of the "3 Dice Big Wheel" circle 114 for a specific 3-of-a-kind bet, such as 3 "1's" as shown in pie section 115 within "3 Dice Big Wheel" circle 114. Bets on individual numbers may be placed on individual numbers 4–17 within rectangle 116.

For example, a wager that the 3-dice combination will total the number 8 is placed on the "8" square 117 positioned within rectangle 116. A bet that the 3-dice combination will total any one of the numbers "4," "7," "10," "13," or "16" may be placed in rectangle 118 positioned adjacent to rectangle 116. A bet that the 3-dice combination will total a number ranging from 7 to 10 may be placed anywhere within area 119, which encompasses the area marked "$$ 7 to 10 $$" as shown within upper section 11 of game table 10.

Lower section 12 of game table 10 provides a player with a view of the pay-out odds for a given bet. For example, as shown in line 121, the pay-out odds for a winning bet on a specific 3-of-a-kind bet is 175 to 1. As shown in line 122, the pay-out odds for a winning bet that the 3-dice combination totals the number 10 or 11 is 5 to 1. As can be seen in rectangle 118 described above, the pay-out odds for a winning bet that the 3-dice combination totals any one of "4," "7," "10," "13," or "16" is 1.5 to 1.

FIG. 2 displays an exemplary game table 20 for use in playing the dice game of the present invention wherein the dice game comprises four dice. Game table 20 comprises an upper section 21 and a lower section 22 separated by horizontal line 23. Game table 20 also comprises two substantially similar halves 24 and 25 separated by vertical line 26. Left half 24 and right half 25 are substantially similar to one another, almost mirror images of one another, except for the "4 Dice Big Wheel" circle 215, which is bisected by vertical line 26. Upper section 21 of FIG. 2 displays possible rolls (i.e., combinations of the four dice) in the dice game, while lower section 22 displays some of the "pay-out odds" for a winning roll.

Within upper section 21, individual bets (not shown) may be placed in one or more of the following areas corresponding to a given bet: the "Any Pair" rectangle 211; the "Straight" rectangle 212; the "Any 3-of-a-kind" rectangle 213; the "Baby Wheel" circle 214 for any 4-of-a-kind bet; and one or more pie sections of the "4 Dice Big Wheel" circle 215 for a specific 4-of-a-kind bet, such as 4 "6's" as shown in pie section 220 within "4 Dice Big Wheel" circle 215. Bets on individual numbers may be placed on individual numbers 5–23 within rectangle 216. For example, a wager that the 4-dice combination will total the number 12 will be placed on the "12" square 217 positioned within rectangle 216. A bet that the 4-dice combination will total any one of the numbers "5," "8," "11," "14," "17," "20," or "23" may be placed in rectangle 218 positioned adjacent to rectangle 216. A bet that the 4-dice combination will total a number ranging from 6 to 13 may be placed anywhere within rectangle 219, which encompasses the area marked "$$ 6 to 13 $$" as shown within upper section 21 of game table 20.

Lower section 22 of game table 20 provides a player with a view of the pay-out odds for a given bet in the 4 dice game. For example, as shown in line 221, the pay-out odds for a winning bet on a specific 4-of-a-kind bet is 1000 to 1. As shown in line 222, the pay-out odds for a winning bet that the 4-dice combination totals the number 10 or 18 is 12 to 1. As can be seen in rectangle 218 described above, the pay-out odds for a winning bet that the 4-dice combination totals any one of "5," "8," "11," "14," "17," "20," or "23" is 1.5 to 1.

FIG. 3 displays an exemplary game table 30 for use in playing the dice game of the present invention wherein the dice game comprises five dice. Game table 30 comprises an upper section 31 and a lower section 32 separated by horizontal line 33. Game table 30 also comprises two substantially similar halves 34 and 35 separated by vertical line 36. Left half 34 and right half 35 are substantially similar to one another, almost mirror images of one another, except for the "5 Dice Big Wheel" circle 317, which is bisected by vertical line 36. Upper section 31 of FIG. 3 displays possible rolls (i.e., combinations of the five dice) in the dice game, while lower Section 32 displays some of the "pay-out odds" for a winning roll.

Within upper section 31, individual bets (not shown) may be placed in one or more of the following areas corresponding to a given bet: the "Any 2 Pair" rectangle 311; the "Straight" rectangle 312; the "Any 3-of-a-kind" rectangle 313; the "Full House" rectangle 314; the "Any 4-of-a-kind" rectangle 315; the "Baby Wheel" circle 316 for any 5-of-a-kind bet; and one or more pie sections of the "5 Dice Big Wheel" circle 317 for a specific 5-of-a-kind bet, such as 5 "6's" as shown in pie section 328 within "5 Dice Big Wheel" circle 317. Bets on individual numbers may be placed on individual numbers 6–29 within rectangle 316. For example, a wager that the 5-dice combination will total the number 17 will be placed on the "17" square 319 positioned within rectangle 318. A bet that the 5-dice combination will total any one of the numbers "6," "9," "12," "15," "18," "21," "24," or "27" may be placed in rectangle 320 positioned adjacent to rectangle 318.

Lower section 32 of game table 30 provides a player with a view of the pay-out odds for a given bet in the 5 dice game. For example, as shown in line 322, the pay-out odds for a winning bet on a "Full House" bet is 20 to 1. As shown in line 323, the pay-out odds for a winning bet that the 5-dice combination totals the number 17 or 18 is 5 to 1. As can be seen in rectangle 320 described above, the pay-out odds for a winning bet that the 5-dice combination totals any one of "6," "9," "12," "15," "18," "21," "24," or "27" is 1.5 to 1.

In one embodiment of the present invention, a portion of the game table may provide an area suitable for rolling the dice. For example, a wall having a height of approximately 2.54 cm. (1 in.) up to about 25.4 cm. (10 in.) may be positioned along horizontal line 13 (see FIG. 1) to allow players positioned along lower section 12 to roll the dice in the pay-out odds area within lower section 12 of game table 10. It should be noted that the game table of FIG. 1 is used as an example, and a wall could be used on any game table. Desirably, the wall is a made of a transparent material, such as glass of plastic, to allow players to view the game table through the transparent wall.

The wall along horizontal line 13 may move vertically from a "down" position inside the game table to an "up" position, wherein a portion of the transparent wall is above the upper surface of the game table, depending on the stage of the game. For example, while players are placing bets, the transparent wall may be positioned in a "down" position inside the game table. Once all bets are made final (i.e., prior to the roll of the dice), the wall may be moved to an "up" position to provide a dice-rolling area on one side of the transparent wall. The position of the wall may be electronically controlled by a casino employee managing the dice game.

In a further embodiment of the present invention, at least a portion of the game table is depressed so as to provide a "pit-like" area for rolling the dice. In one example of this embodiment, the depressed area may encompass the entire lower section 12 of game table 10 or a smaller portion of lower section 12, such as the area containing the pay-out odds.

C. Roll History Display

Figure 4:
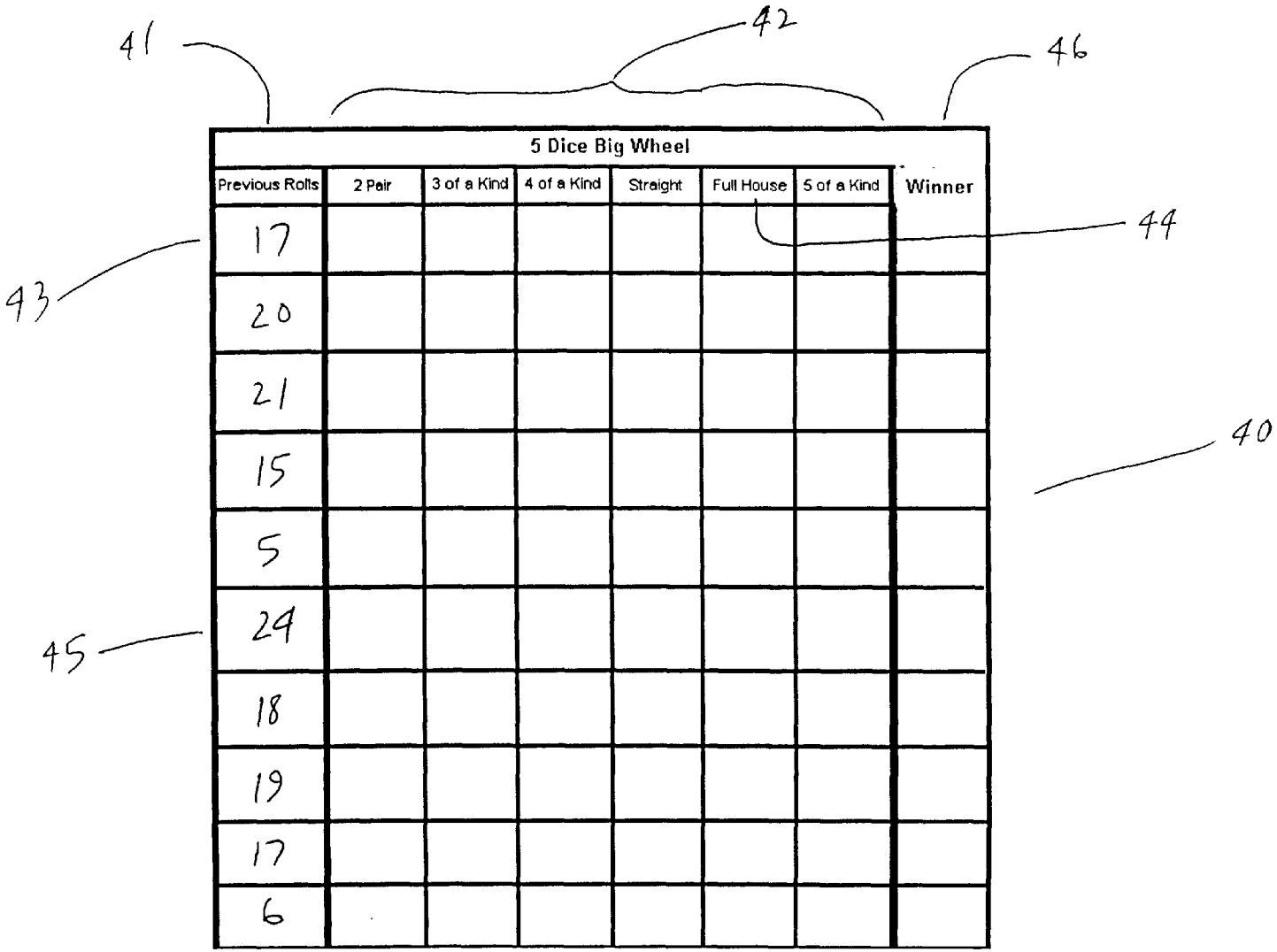
FIG. 4 depicts an exemplary roll history display for a dice game using 5 dice.

The dice game may further comprise a display, which provides a roll history for a given table (e.g., a display of the last ten rolls of a given table). An exemplary roll history display is shown in FIG. 4. Roll history display 40 may comprise a first column 41, which indicates the last rolls of the dice. As shown in column 41, the last roll of the dice was the number 17, which was preceded by the number 20. The roll history display 40 may provide any number of previous rolls of the dice. Desirably, roll history display 40 displays at least eight previous rolls of the dice.

Roll history display 40 may also comprise columns 42, which provide special roll outcomes corresponding to a given combination of dice. The individual squares contained in columns 42 within roll history display 40 may light up to indicate when a special combination of dice is rolled. For example, in row 43, if the dice, which total the number 17, comprise two 4s and three 3s, the full house square 44 lights up or displays a color different from the other blocks in row 43 within columns 42. In some cases, more than one block may light up on a given roll of the dice. For example, in row 45 if the five dice totaling 24 are four 5s and one 4, the following blocks will light up: "Any 2 Pair," "3-of-a-kind," and "Any 4-of-a-kind." In addition, roll history display 40 may further comprise column 46, which indicates whether or not there was one or more winners for a given roll. The individual squares contained in column 46 may light up or display a special color to indicate when a given past roll resulted in one or more winners.

Roll history display 40, as shown in FIG. 4, is specifically designed for a five-dice game; however, it should be understood that roll history displays may vary depending on the number of dice used. Roll history display 40 may have a design, shape and size, which may vary depending on a number of factors including, but not limited to, the available space for the roll history display, the number of previous rolls displayed on the roll history display, and the size of the lettering on the roll history display. The roll history display 40 may be positioned at any location within the view of the players. One possible location for the roll history display 40 is above the casino operator (not shown), who assists the players in placing bets. In one embodiment of the present invention, the roll history display 40 is placed above the casino operator, wherein the casino operator is positioned adjacent to the "5-Dice Big Wheel" (or the "3-Dice Big Wheel" in FIG. 1 or the "4-Dice Big Wheel" in FIG. 2) while the players are positioned along an opposite portion of the game table, such as lower section 32, which displays the pay-out odds to the players (i.e., along lower section 32 shown in FIG. 3 for a five-dice game).

D. Dice Game Board

In a further embodiment of the present invention, the dice game may be played on a game board. The game board may have a board design such as shown in FIGS. 1–3. The game board may be made of conventional game board materials including, but not limited to, cardboard, paper, plastic film, and ink. The game board may be of any desired size and shape. Desirably, the game board has an oval shape, such as shown in FIGS. 1–3.

In one embodiment of the present invention, the game board has an oval shape and an overall length of from about 61 cm. (24 in.) to about 152 cm. (60 in.), and an overall width of from about 30 cm. (12 in.) to about 122 cm. (48 in.).

E. Dice Pit

In a further embodiment of the present invention, the dice board game may comprise a "dice pit" separate from, connected to, or attachable to the game board. The "dice pit" may be a "pan-like" container having a lower surface and a wall along an outer perimeter of the lower surface. The "dice pit" may be used to contain and control the dice during a roll of the dice. The "dice pit" enables control of the dice during the step of rolling the dice to prevent placed bets from being unintentionally moved during the dice rolling step.

The "dice pit" may have any dimensions and shape. Typically, the dice pit has a square, rectangular or circular shape and a lower surface dimension ranging from about 15 cm. (6 in.) to about 60 cm. (24 in.) and a wall height of up to about 7.6 cm. (3 in.).

F. Electronic Dice Game

In yet a further embodiment of the present invention, the dice game may be played on an electronic device. Suitable electronic devices include, but are not limited to, a video poker type machine, a handheld electronic device such as a GAME-BOY™, a NINTENDO™ type device for use with a conventional television, and a personal computer.

On each of the possible electronic devices, a display may be made available to the player, wherein at least a portion of the display contains a table design, such as shown in FIGS. 1–3. A number of mechanical devices may be used to interact with the table design on the electronic display. Suitable mechanical devices include, but are not limited to, buttons (e.g., on a video poker type machine); a cursor ball, such as found on some video poker type machines for positioning a cursor on the electronic display; a touch-screen (e.g., on a video poker type machine); a keyboard; a mouse for positioning a cursor on a personal computer video display; a touch-pad for positioning a cursor on a personal computer video display; or a microphone for use with voice recognition software (i.e., for inputting audio commands to the electronic device).

The electronic dice game may be present on a software program, which is installed onto an electronic device such as a NINTENDO™ type device, or may be in the form of an electronic disk, which may be inserted into a hand-held electronic device such as a GAME-BOY™ type electronic device or a personal computer.

G. Money or Reward

The dice game of the present invention may also comprise a reward for rolling a winning roll of the dice. The reward for rolling a winning roll may be in the form of actual money, imitation (i.e., play or fake) money, or tokens representing actual or fake money. In the dice table game of the present invention, the game may be played in a casino, wherein actual currency is bet by a player and paid out by the casino for winning bets. Typically, casino "chips" are used to represent actual money on the game table, although cash may also be used. In the dice board game, actual money may be used; however, other forms of reward may also be used, such as imitation or fake money, such as found in games like MONOPOLY™.

In the electronic version of the dice game, the reward for a winning bet may be in the form of tokens, as in the case of video poker type machines, or points, as in the case of handheld electronic devices or personal computers.

H. Miscellaneous Articles

The dice game of the present invention may also comprise one or more miscellaneous components including, but not limited to, a dice cup for shaking the dice prior to rolling the dice, a bucket for containing tokens, etc.

II. Method of Playing the Dice Game

The present invention is further directed to a method of playing a dice game using from 3 to 5 dice. The method may comprise one or more steps including, but not limited to, choosing a possible roll combination, designating a bet amount, associating the bet amount with the possible roll combination, and initiating a roll of the dice. The method may vary slightly depending on whether the method involves a game table, a game board, or an electronic device as described above.

The method of playing the dice game of the present invention may also comprise establishing pay-out odds for a winning roll of dice, as well as other steps. The method of playing the dice game of the present invention may also comprise one or more steps as described below.

A. Establishing Pay-out Odds

In one embodiment of the present invention, the method comprises establishing pay-out odds for each roll of the dice. A number of factors may be taken into consideration when establishing pay-out odds. Such factors include, but are not limited to, the probability of a given roll using a given number of dice, desired return to the player, a desired profit for the house (i.e., the casino), specific rules of the game, and any combination thereof.

One factor for determining the pay-out odds of a given roll may be the probability of a given roll using a set number of dice. Table 1 below provides the probability of rolling a given number or combination of numbers using from two to five dice.

TABLE 1

Probability of a Given Roll Using From 2 To 5 Dice

| | Number of Dice | | | |
|---|---|---|---|---|
| Roll | 2 Dice | 3 Dice | 4 Dice | 5 Dice |
| 2 | 1/36 | | | |
| 3 | 2/36 | 1/216 | | |
| 4 | 3/36 | 3/216 | 1/1296 | |
| 5 | 4/36 | 6/216 | 4/1296 | 1/7776 |
| 6 | 5/36 | 10/216 | 10/1296 | 5/7776 |
| 7 | 6/36 | 15/216 | 20/1296 | 15/7776 |
| 8 | 5/36 | 21/216 | 35/1296 | 35/7776 |
| 9 | 4/36 | 25/216 | 56/1296 | 70/7776 |
| 10 | 3/36 | 27/216 | 80/1296 | 126/7776 |
| 11 | 2/36 | 27/216 | 104/1296 | 205/7776 |
| 12 | 1/36 | 25/216 | 125/1296 | 305/7776 |
| 13 | | 21/216 | 140/1296 | 420/7776 |
| 14 | | 15/216 | 146/1296 | 540/7776 |
| 15 | | 10/216 | 140/1296 | 651/7776 |
| 16 | | 6/216 | 125/1296 | 735/7776 |
| 17 | | 3/216 | 104/1296 | 780/7776 |
| 18 | | 1/216 | 80/1296 | 780/7776 |
| 19 | | | 56/1296 | 735/7776 |
| 20 | | | 35/1296 | 651/7776 |
| 21 | | | 20/1296 | 540/7776 |
| 22 | | | 10/1296 | 420/7776 |
| 23 | | | 4/1296 | 305/7776 |
| 24 | | | 1/1296 | 205/7776 |
| 25 | | | | 126/7776 |
| 26 | | | | 70/7776 |
| 27 | | | | 35/7776 |
| 28 | | | | 15/7776 |
| 29 | | | | 5/7776 |
| 30 | | | | 1/7776 |
| Pair | 6/36 | 96/216 | 936/1296 | 7056/7776 |
| 2 Pair | | | 96/1296 | 2256/7776 |
| Straight | 10/36 | 24/216 | 72/1296 | 240/7776 |
| 3 of a Kind | | 6/216 | 126/1296 | 1656/7776 |
| 4 of a Kind | | | 6/1296 | 156/7776 |
| 5 of a Kind | | | | 6/7776 |
| Full House | | | | 306/7776 |

As shown in Table 1, the probability of rolling a "2" (i.e., the total of all dice equals "2" when using two dice) is 1/36, while the probability of rolling a "7" using two dice is 6/36. As the number of dice increases, the number of possible combinations also increases. As shown in Table 1, there are 7,776 possible roll combinations using five dice. The probability of rolling five ones for a total dice combination of "5" is 1/7776.

In one desired embodiment, the method of the present invention takes into account the probability of a given roll in determining the pay-out odds for the given roll. Desirably, the pay-out odds for a given roll are less than the inverse probability of having the given roll. For example, the probability of rolling a "30" using five dice is 1/7776. Desirably, the pay-out odds for rolling a "30" is less than 7776 to 1. A number of methods may be used to determine pay-out odds for a given roll. One suitable method is described below.

One method of determining suitable pay-out odds for winning rolls is by using the formula below:

$$p = \frac{y(x-w)}{w}$$

wherein:

p represents the pay-out odds multiple;

y represents the desired yield to the player;

x represents the total number of possible combinations for a given number of dice; and w represents the number of winning bets per x rolls of the dice.

For example, in a five dice game, x is equal to 7776. If one desires the yield to the player to be 80% (i.e., y=0.80), the pay-out odds multiple for rolling the number "10," is calculated by:

$$p = \frac{y(x-w)}{w}$$

$$p = \frac{(0.80)[(7776)-(126)]}{(126)}$$

$$p = 48.57$$

to result in pay-out odds of "48.57 to 1" for a winning roll of the number 10 in a 5 dice game. Typically, pay-out odds are rounding to a whole number, so a suitable result might be "48 to 1" or even "45 to 1."

In the example above, by setting the pay-out odds of "48 to 1" for a winning bet of "10" in a 5 dice game, the yield to the player is theoretically $0.80 for each dollar that the player plays. Further, the amount of money for the house (i.e., the casino) is equal to $0.20 for each dollar that the player plays. By adjusting the yield, y, in the formula above, the amount of money for the house (i.e., the casino) may be adjusted as desired.

Tables 2–4 below provide payment odds for a given roll in a three-dice game, four-dice game, and five-dice game, respectively, to yield a desired return to a player (and a desired return to the house) using the desired formula above.

TABLE 2

Payment Odds for a Given Roll in a Three-Dice Game To Yield a Desired Return to a Player

| Roll | # Rolls Per 216 Rolls | Payment Odds To Yield Below Return To Player .65 | .70 | .75 | .80 | .85 | .90 |
|---|---|---|---|---|---|---|---|
| 3 | 1 | 139.75 | 150.50 | 161.25 | 172.00 | 182.75 | 193.50 |
| 4 | 3 | 46.15 | 49.70 | 53.25 | 56.80 | 60.35 | 63.90 |
| 5 | 6 | 22.75 | 24.50 | 26.25 | 28.00 | 29.75 | 31.50 |
| 6 | 10 | 13.39 | 14.42 | 15.45 | 16.48 | 17.51 | 18.54 |
| 7 | 15 | 8.71 | 9.38 | 10.05 | 10.72 | 11.39 | 12.06 |
| 8 | 21 | 6.04 | 6.50 | 6.96 | 7.43 | 7.89 | 8.36 |
| 9 | 25 | 4.97 | 5.35 | 5.73 | 6.11 | 6.49 | 6.88 |
| 10 | 27 | 4.55 | 4.90 | 5.25 | 5.60 | 5.95 | 6.30 |
| 11 | 27 | 4.55 | 4.90 | 5.25 | 5.60 | 5.95 | 6.30 |
| 12 | 25 | 4.97 | 5.35 | 5.73 | 6.11 | 6.49 | 6.88 |
| 13 | 21 | 6.04 | 6.50 | 6.96 | 7.43 | 7.89 | 8.36 |
| 14 | 15 | 8.71 | 9.38 | 10.05 | 10.72 | 11.39 | 12.06 |
| 15 | 10 | 13.39 | 14.42 | 15.45 | 16.48 | 17.51 | 18.54 |
| 16 | 6 | 22.77 | 24.50 | 26.25 | 28.00 | 29.75 | 31.50 |
| 17 | 3 | 46.15 | 49.70 | 53.25 | 56.80 | 60.35 | 63.90 |
| 18 | 1 | 139.75 | 150.50 | 161.25 | 172.00 | 182.75 | 193.50 |
| Pair | 96 | .81 | .88 | .94 | 1.00 | 1.06 | 1.13 |
| Straight | 24 | 5.20 | 5.60 | 6.00 | 6.40 | 6.80 | 7.20 |
| 3 of a Kind | 6 | 22.75 | 24.50 | 26.25 | 28.00 | 29.75 | 31.50 |
| Specific 3 of a Kind | 1 | 139.75 | 150.50 | 161.25 | 172.00 | 182.75 | 193.50 |
| 3–6 or 15–18 | 20 | 6.37 | 6.86 | 7.35 | 7.84 | 8.33 | 8.82 |
| 3–7 or 14–18 | 70 | 1.36 | 1.46 | 1.56 | 1.67 | 1.77 | 1.88 |
| 8 & 9, 12 & 13 | 92 | .88 | .94 | 1.01 | 1.08 | 1.15 | 1.21 |
| 10 & 11 | 54 | 1.95 | 2.10 | 2.25 | 2.40 | 2.55 | 2.70 |
| 5 & 6, 15 & 16 | 32 | 3.74 | 4.03 | 4.31 | 4.60 | 4.89 | 5.18 |
| 7–10 or 11–14 | 88 | .95 | 1.02 | 1.09 | 1.16 | 1.24 | 1.31 |

TABLE 3

Payment Odds for a Given Roll in a Four-Dice Game To Yield a Desired Return to a Player

| Roll | # Rolls Per 1296 Rolls | Payment Odds To Yield Below Return To Player .65 | .70 | .75 | .80 | .85 | .90 |
|---|---|---|---|---|---|---|---|
| 4 | 1 | 841.75 | 906.50 | 971.25 | 1036.00 | 1100.75 | 1165.50 |
| 5 | 4 | 209.95 | 226.10 | 242.25 | 258.40 | 274.55 | 290.70 |
| 6 | 10 | 83.59 | 90.02 | 96.45 | 102.88 | 109.31 | 115.74 |
| 7 | 20 | 41.47 | 44.66 | 47.85 | 51.04 | 54.23 | 57.42 |
| 8 | 35 | 23.42 | 25.22 | 27.02 | 28.82 | 30.62 | 32.43 |
| 9 | 56 | 14.39 | 15.50 | 16.61 | 17.71 | 18.82 | 19.93 |
| 10 | 80 | 9.88 | 10.64 | 11.40 | 12.16 | 12.92 | 13.68 |
| 11 | 104 | 7.45 | 8.02 | 8.60 | 9.17 | 9.74 | 10.32 |
| 12 | 125 | 6.09 | 6.56 | 7.03 | 7.49 | 7.96 | 8.43 |
| 13 | 140 | 5.37 | 5.78 | 6.19 | 6.61 | 7.02 | 7.43 |
| 14 | 146 | 5.12 | 5.51 | 5.91 | 6.30 | 6.70 | 7.09 |
| 15 | 140 | 5.37 | 5.78 | 6.19 | 6.61 | 7.02 | 7.43 |
| 16 | 125 | 6.09 | 6.56 | 7.03 | 7.49 | 7.96 | 8.43 |
| 17 | 104 | 7.45 | 8.02 | 8.60 | 9.17 | 9.74 | 10.32 |
| 18 | 80 | 9.88 | 10.64 | 11.40 | 12.16 | 12.92 | 13.68 |
| 19 | 56 | 14.39 | 15.50 | 16.61 | 17.71 | 18.82 | 19.93 |
| 20 | 35 | 23.42 | 25.22 | 27.02 | 28.82 | 30.62 | 32.43 |
| 21 | 20 | 41.47 | 44.66 | 47.85 | 51.04 | 54.23 | 57.42 |
| 22 | 10 | 83.59 | 90.02 | 96.45 | 102.88 | 109.31 | 115.74 |

TABLE 3-continued

Payment Odds for a Given Roll in a Four-Dice Game To Yield a Desired Return to a Player

| Roll | # Rolls Per 1296 Rolls | Payment Odds To Yield Below Return To Player .65 | .70 | .75 | .80 | .85 | .90 |
|---|---|---|---|---|---|---|---|
| 23 | 4 | 209.95 | 226.10 | 242.25 | 258.40 | 274.55 | 290.70 |
| 24 | 1 | 841.75 | 906.50 | 971.25 | 1036.00 | 1100.75 | 1165.50 |
| Pair | 936 | .25 | .27 | .29 | .31 | .33 | .35 |
| 2 Pair | 96 | 8.13 | 8.75 | 9.38 | 10.00 | 10.63 | 11.25 |
| Straight | 72 | 11.05 | 11.90 | 12.75 | 13.60 | 14.45 | 15.30 |
| 3 of a Kind | 126 | 6.04 | 6.50 | 6.96 | 7.43 | 7.89 | 8.36 |
| 4 of a Kind | 6 | 139.75 | 150.50 | 161.25 | 172.00 | 182.75 | 193.50 |
| Specific 4 of a Kind | 1 | 841.75 | 906.50 | 971.25 | 1036.00 | 1100.75 | 1165.50 |
| 4–6 or 22–24 | 15 | 55.51 | 59.78 | 64.05 | 68.32 | 72.59 | 76.86 |
| 4–6 and 22–24 | 30 | 27.43 | 29.54 | 31.65 | 33.76 | 35.87 | 37.98 |
| 6–13 or 15–22 | 570 | .83 | .89 | .96 | 1.02 | 1.08 | 1.15 |
| 9–12 or 16–19 | 365 | 1.66 | 1.79 | 1.91 | 2.04 | 2.17 | 2.30 |
| 4–10 or 18–24 | 206 | 3.44 | 3.70 | 3.97 | 4.23 | 4.50 | 4.76 |
| 10 & 11 or 17 & 18 | 184 | 3.93 | 4.23 | 4.53 | 4.84 | 5.14 | 5.44 |
| 8–11 or 17–20 | 275 | 2.41 | 2.60 | 2.79 | 2.97 | 3.16 | 3.34 |

TABLE 4

Payment Odds for a Given Roll in a Five-Dice Game To Yield a Desired Return to a Player

| Roll | # Rolls Per 7776 Rolls | Payment Odds To Yield Below Return To Player .65 | .70 | 75 | 80 | .85 | .90 |
|---|---|---|---|---|---|---|---|
| 5 | 1 | 5053.75 | 5442.50 | 5831.25 | 6220.04 | 6608.75 | 6997.51 |
| 6 | 5 | 1010.23 | 1087.94 | 1165.65 | 1243.36 | 1321.07 | 1398.78 |
| 7 | 15 | 336.31 | 362.18 | 388.05 | 413.92 | 439.79 | 465.66 |
| 8 | 35 | 143.76 | 154.82 | 165.88 | 176.94 | 188.00 | 199.05 |
| 9 | 70 | 71.56 | 77.06 | 82.56 | 88.07 | 93.57 | 99.08 |
| 10 | 126 | 39.46 | 42.50 | 45.54 | 48.57 | 51.61 | 54.64 |
| 11 | 205 | 24.01 | 25.85 | 27.70 | 29.55 | 31.39 | 33.24 |
| 12 | 305 | 15.92 | 17.15 | 18.37 | 19.60 | 20.82 | 22.05 |
| 13 | 420 | 11.38 | 12.26 | 13.14 | 14.01 | 14.89 | 15.76 |
| 14 | 540 | 8.71 | 9.38 | 10.05 | 10.72 | 11.39 | 12.06 |
| 15 | 651 | 7.11 | 7.66 | 8.21 | 8.76 | 9.30 | 9.85 |
| 16 | 735 | 6.23 | 6.71 | 7.19 | 7.66 | 8.14 | 8.62 |
| 17 | 780 | 5.83 | 6.28 | 6.73 | 7.18 | 7.62 | 8.07 |
| 18 | 780 | 5.83 | 6.28 | 6.73 | 7.18 | 7.62 | 8.07 |
| 19 | 735 | 6.23 | 6.71 | 7.19 | 7.66 | 8.14 | 8.62 |
| 20 | 651 | 7.11 | 7.66 | 8.21 | 8.76 | 9.30 | 9.85 |
| 21 | 540 | 8.71 | 9.38 | 10.05 | 10.72 | 11.39 | 12.06 |
| 22 | 420 | 11.38 | 12.26 | 13.14 | 14.01 | 14.89 | 15.76 |
| 23 | 305 | 15.92 | 17.15 | 18.37 | 19.60 | 20.82 | 22.05 |
| 24 | 205 | 24.01 | 25.85 | 27.70 | 29.55 | 31.39 | 33.24 |
| 25 | 126 | 39.46 | 42.50 | 45.54 | 48.57 | 51.61 | 54.64 |
| 26 | 70 | 71.56 | 77.06 | 82.56 | 88.07 | 93.57 | 99.08 |
| 27 | 35 | 143.76 | 154.82 | 165.88 | 176.94 | 188.00 | 199.05 |
| 28 | 15 | 336.31 | 362.18 | 388.05 | 413.92 | 439.79 | 465.66 |
| 29 | 5 | 1010.23 | 1097.94 | 1165.65 | 1243.36 | 1321.07 | 1398.78 |
| 30 | 1 | 5053.75 | 5442.50 | 5831.25 | 6220.04 | 6608.75 | 6997.51 |

TABLE 4-continued

| | Payment Odds for a Given Roll in a Five-Dice Game To Yield a Desired Return to a Player | | | | | | |
|---|---|---|---|---|---|---|---|
| | # Rolls Per 7776 | Payment Odds To Yield Below Return To Player | | | | | |
| Roll | Rolls | .65 | .70 | 75 | 80 | .85 | .90 |
| Pair | 7056 | .067 | .072 | .077 | .082 | .088 | .093 |
| 2 Pair | 2256 | 1.59 | 1.71 | 1.84 | 1.96 | 2.08 | 2.20 |
| Straight | 240 | 20.41 | 21.98 | 23.55 | 25.12 | 26.69 | 28.26 |
| 3 of a Kind | 1656 | 2.40 | 2.59 | 2.77 | 2.96 | 3.14 | 3.33 |
| 4 of a Kind | 156 | 31.75 | 34.19 | 36.64 | 39.08 | 41.52 | 43.96 |
| Full House | 306 | 15.87 | 17.09 | 18.31 | 19.53 | 20.75 | 21.97 |
| Any 5 of a Kind | 6 | 841.75 | 906.50 | 971.25 | 1036.00 | 1100.75 | 1165.50 |
| Specific 5 of a Kind | 1 | 5053.75 | 5442.50 | 5831.25 | 6220.04 | 6608.75 | 6997.51 |
| 12–17 or 18–23 | 3431 | .823 | .89 | .95 | 1.01 | 1.08 | 1.14 |
| 16–19 | 3030 | 1.01 | 1.10 | 1.18 | 1.25 | 1.33 | 1.41 |
| 5–11 & 24–30 | 914 | 4.88 | 5.26 | 5.63 | 6.01 | 6.38 | 6.76 |
| 10–14 & 21–25 | 3192 | .93 | 1.01 | 1.08 | 1.15 | 1.22 | 1.29 |
| 15 & 20 | 1302 | 3.23 | 3.48 | 3.73 | 3.98 | 4.23 | 4.48 |
| 5, 7, 9, 11, 13, 15, 17, - or - 20, 22, 24, 26, 28, 30 | 2142 | 1.71 | 1.84 | 1.97 | 2.10 | 2.24 | 2.37 |
| 10–14 or 21–25 | 1596 | 2.52 | 2.71 | 2.90 | 3.10 | 3.29 | 3.49 |
| 13–15 or 20–22 | 1611 | 2.49 | 2.68 | 2.87 | 3.06 | 3.25 | 3.44 |
| 11–15 or 20–24 | 2121 | 1.73 | 1.87 | 2.00 | 2.13 | 2.27 | 2.40 |
| 13–16 or 19–22 | 2346 | 1.50 | 1.62 | 1.74 | 1.85 | 1.97 | 2.08 |
| 5–16 or 19–30 | 3108 | .98 | 1.05 | 1.13 | 1.20 | 1.28 | 1.35 |

B. The Casino Dice Game

As described above, the dice game of the present invention may be played using a set of dice and a game table as shown in FIGS. 1–3. In this embodiment of the present invention, the method of playing the dice game comprises one or more of the following steps: (1) designating a roller of the dice; (2) placing one or more bets on one or more possible outcomes of the dice roll; (3) rolling the dice; (4) removing losing bets from the game table; and (5) paying one or more winning bets based on pay-out odds for the given bet.

In the step of designating a particular roller of the dice, the step may be eliminated when only one player is playing the game. When more than one player is playing the game, a player may roll the dice one or more times at his or her choosing, and then forward the dice clockwise to the next player. Desirably, each player is given the option to roll the dice at least once in order to maintain interest in the game. However, in some cases, a player may choose not to roll the dice, and may pass on his or her opportunity to roll the dice.

In one desired embodiment of the present invention, each player is given the opportunity to roll the dice if he or she chooses. Each player may roll the dice up to a predetermined number of times and then passes the dice to the next roller to provide each player with an opportunity to roll the dice. Desirably, each player rolls the dice three times and then passes the dice to the next roller.

The step of placing a bet typically involves a request to a casino employee to place a given amount on a location of the game table as described in FIGS. 1–3. In most cases, the game table is of such a size that it is difficult for a given player to reach all of the locations on the table. Further, it is desirable for the betting locations to be positioned outside of arm's reach of the players in order to eliminate the possibility of a player manipulating a given bet during or after the roll of the dice. One possible player position is along an outer perimeter of a game table, for example, along lower section 32 (see FIG. 3) so that players can read the odds and interact with the casino employee. Desirably, the casino employee is positioned on an opposite side of the game table, such as a position adjacent to the "5-Dice Big Wheel" 317 in FIG. 3.

Prior to placing a bet, a player may refer to the roll history display, when present, to observe a roll history for the game table. Roll history displays have been described above.

One or more bets may be played by each player, and one or more players may place a bet on the same outcome. When two or more players place a bet on the same outcome, the casino employee in charge of the game table positions the bets relative to the position of the players to one another. For example, if players A, B and C all place $5 bets on the number "8" (rectangle 117 in FIG. 1) and players A, B and C are positioned along lower section 12 of game table 10, then the casino table operator will position the bets of the players A, B and C along the lower side of rectangle 117 closest to horizontal line 13 on table 10.

The method of playing the dice game in this particular embodiment may further include a step prior to rolling the dice, wherein the casino table operator give each player the option to change his or her bet or the amount of the bet prior to rolling the dice. Once the casino table operator has given each player this option and changes, if any, have been made to the bets, the casino table operator typically announces that all bets are final, and requests that the roller proceed to roll the dice.

Typically, a player with a winning bet is paid based on the pay-out odds of the bet using casino tokens (chips), which may range in value from $0.50 up to $10,000. A player with a winning bet keep his or her original bet and is paid an amount of winnings based on the pay-out odds of the bet. Once a player has finished playing the dice game, the player may cash in any casino chips to obtain the desired currency.

C. Method of Playing the Board Game

The method of playing the dice game of the present invention may also include a game board as described above. In this embodiment of the present invention, the method of playing may include one or more of the method steps described above in regard to the casino table game and/or one or more additional steps. In the board game method, one player or observer is designated to be the casino or "banker." The banker controls the collection and pay-out of money for a given bet or series of bets.

Any process may be used to determine the first roller of the dice. Suitable methods include, but are not limited to, having each player roll the dice wherein the roller of the highest number is designated the first roller of the dice to start the board game. Desirably, each player takes his or her turn rolling the dice. The dice are passed clockwise from player to player giving each player an opportunity to roll the dice.

In one embodiment of the present invention, players may start the board game with a designated amount of money to be used on making one or more bets per roll of the dice. If a player runs out of money, the player is out of the game. The first player to reach a designated amount of money or the last player to remain in the game is declared the winner of the board game.

Money used in this embodiment may be imitation money, such as found in a MONOPOLY™ game. Denominations of bills can range from $1 up to $10,000.

The method of playing the board game may include a step wherein the banker or spectator asks each player if they want to modify, or make additional bets. At some point after bets are modified, the banker or spectator declares that all bets are final, and asks the current roller to roll the dice.

D. Method of Playing the Electronic Version of the Dice Game

As explained above, the dice game of the present invention may also be played on an electronic device. In addition to the one or more method steps described above with regard to the table dice game and the board dice game, the method of playing the electronic version of the dice game may contain one or more additional steps. Suitable additional steps in the electronic version of the dice game may include, but are not limited to, inputting one or more coins or tokens into the electronic device; canceling a given bet by using one of more mechanical devices as described above (i.e., button, touch screen, etc.); selecting a roll outcome using one or more mechanical devices as described above; verifying a given selected roll outcome by responding to a prompt from the electronic device; and rolling the dice by initiating a roll through one or more mechanical devices as described above.

The step of inputting coins or tokens into the electronic device may allow a player to deposit multiple coins for storage in a player account, so that the player may make multiple bets in series with one or another after depositing coins into the account. As a player places a bet, the amount of the bet is subtracted from the players account. If the player wins the bet, the original bet amount and an amount of winnings based on the pay-out odds for the winning bet are automatically paid to the player. The winnings paid out to the player may be paid directly to the player in the form of coins or tokens, or the amount of winnings may be deposited directly into the player's account for future use.

The step of placing a bet on the electronic device may entail pushing a button, moving a cursor over the display screen to a particular location for placing a bet (i.e., on a table design as shown in FIGS. 1–3), or simply touching the display screen. Throughout the process of placing a bet and determining an amount of the bet, the electronic device may provide prompts to the player to confirm or verify a particular bet.

In one embodiment of the present invention, the step of rolling the dice involves simply pushing a button. Desirably, the display screen displays the following components: a table design showing one or more bets made by the player or players; a display, which shows the dice rolling and ultimately stopping on a roll combination; and the balance in a player's account. The electronic device may be programmed to provide light and/or sound for winning bets and/or losing bets.

III. Special Rules That May Be Used For Dice Game

The dice game of the present invention may include one or more special rules depending on the number of dice rolled. The following rules described below may be used to play the game, but are not required.

A. Three-Dice Game Rules

Some special rules for the 3 dice game may include, but are not limited to:

(1) If player A bets on a pair, no player bets on 3-of-a-kind, and 3-of-a-kind is rolled, player A wins the pair bet; and (2) If player A bets on a pair, and player B bets on 3-of-a-kind, and 3-of-a-kind is rolled, player B wins on the 3-of-a-kind bet, and player A wins the pair bet.

B. Four-Dice Game Rules

Some special rules for the 4 dice game may include, but are not limited to:

(1) If player A bets on a pair, no player bets on 2 pair, 3-of-a-kind, or 4-of-a-kind, and one of 2 pair, 3-of-a-kind, or 4-of-a-kind is rolled, player A wins the pair bet;

(2) If player A bets on a pair, and player B bets on any one of 2 pair, 3-of-a-kind, or 4-of-a-kind, and one of 2 pair, 3-of-a-kind, or 4-of-a-kind is rolled, player B wins on the 2 pair, 3-of-a-kind, or 4-of-a-kind bet, and player A wins the pair bet;

(3) If player A bets on 2 pair, no player bets on 4-of-a-kind, and 4-of-a-kind is rolled, player A wins the 2 pair bet;

(4) If player A bets on 2 pair, and player B bets on 4-of-a-kind, and 4-of-a-kind is rolled, player B wins on the 4-of-a-kind bet, and player A wins the pair bet;

(5) If player A bets on 3-of-a-kind, no player bets on 4-of-a-kind, and 4-of-a-kind is rolled, player A wins the 3-of-a-kind bet; and (6) If player A bets on 3-of-a-kind, and player B bets on 4-of-a-kind, and 4-of-a-kind is rolled, player B wins on the 4-of-a-kind bet, and player A wins the 3-of-a-kind bet.

C. Five Dice Game Rules

Some special rules for the 5 dice game may include, but are not limited to:

(1) If player A bets on 2 pair, no player bets on a full house, 4-of-a-kind, or 5-of-a-kind, and a full house, 4-of-a-kind, or 5-of-a-kind is rolled, player A wins the 2-pair bet;

(2) If player A bets on 2 pair, and player B bets on a full house, 4-of-a-kind, or 5-of-a-kind, and a full house, 4-of-a-kind, or 5-of-a-kind is rolled, player B wins on the a full house, 4-of-a-kind, or 5-of-a-kind bet, and player A wins the 2-pair bet;

(3) If player A bets on 3-of-a-kind, no player bets on a full house, 4-of-a-kind, or 5-of-a-kind, and a full house, 4-of-a-kind, or 5-of-a-kind is rolled, player A wins the 3-of-a-kind bet;

(4) If player A bets on 3-of-a-kind, and player B bets on any one of a full house, 4-of-a-kind, or 5-of-a-kind, and a full house, 4-of-a-kind, or 5-of-a-kind is rolled, player B wins on the full house, 4-of-a-kind, or 5-of-a-kind bet, and player A win the 3-of-a-kind bet;

(5) If player A bets on a full house, no player bets on 5-of-a-kind, and a 5-of-a-kind is rolled, player A wins the full house bet;

(6) If player A bets on a full house, and player B bets on 5-of-a-kind, and 5-of-a-kind is rolled, player B wins on the 5-of-a-kind bet, and player A wins the full house bet;

(7) If player A bets on 4-of-a-kind, no player bets on 5-of-a-kind, and a 5-of-a-kind is rolled, player A wins the 4-of-a-kind bet; and (8) If player A bets on 4-of-a-kind, and player B bets on 5-of-a-kind, and 5-of-a-kind is rolled, player B wins on the 5-of-a-kind bet, and player A wins the 4-of-a-kind bet.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of playing a dice game comprising the steps of:

selecting a roll outcome from a number of possible single roll combinations resulting from a single roll of from 3 to 5 dice;

rolling the dice; and paying an amount of winnings to a player for a winning single roll outcome, wherein the amount of winnings is based on pay-out odds assigned to each of the possible single roll combinations of the dice;

wherein the dice game has pay-out odds of up to "6000 to 1" or greater, and wherein each roll of the dice has a potential winner, and wherein the pay-out odds are determined using a formula below:

$$p = \frac{y(x-w)}{w}$$

wherein:

p represents a pay-out odds multiple;

y represents a desired yield to the player;

x represents a total number of the possible roll combinations; and w represents a probable number of winning bets per x rolls of the dice.

2. The method of claim 1, further comprising one or more steps comprising:

(1) designating a bet amount;

(2) associating the bet amount with the selected roll outcome;

(3) designating a roller of the dice;

(4) placing one or more bets on one or more bet locations on a game table having a table design as shown in any one of FIGS. 1–3;

(5) removing losing bets from the game table;

(6) rolling the dice up to a predetermined number of times and then passing the dice to another roller to provide each player with an opportunity to roll the dice;

(7) requesting a casino table operator to place a given amount on a bet location of a game table;

(8) viewing a roll history display to observe a roll history for the game table prior to rolling the dice;

(9) changing a bet or an amount of a bet prior to rolling the dice;

(10) changing a bet or an amount of a bet prior to a casino table operator's announcement that all bets are final;

(11) in response to a casino table operator's announcement that all bets are final, proceeding to the dice rolling step; and

(12) paying a player with a winning bet (i) the bet amount, and (ii) an amount of winnings based on the pay-out odds of the bet, wherein the winnings is paid in casino chips.

3. The method of claim 1, further comprising one or more steps comprising:

(1) designating a bet amount;

(2) associating the bet amount with the selected roll outcome;

(3) designating a roller of the dice;

(4) providing each player with a predetermined amount of imitation money to be used on making one or more bets per roll of the dice;

(5) placing one or more bets on one or more bet locations on a game board having a board design as shown in any one of FIGS. 1–3;

(6) removing losing bets from the game board;

(7) rolling the dice up to a predetermined number of times and then passing the dice to another roller to provide each player with an opportunity to roll the dice;

(8) changing a bet or an amount of a bet prior to rolling the dice;

(9) changing a bet or an amount of a bet prior to a final instruction by a game board facilitator;

(10) in response to a game board facilitator's announcement that all bets are final, proceeding to the dice rolling step; and

(11) paying a player with a winning bet (i) the bet amount, and (ii) an amount of winnings based on the pay-out odds of the bet, wherein the winnings are paid in imitation money or tokens.

4. The method of claim 1, further comprising one or more steps comprising:

(1) inputting one or more coins or tokens into an electronic device;

(2) designating a bet amount via one of more mechanical devices;

(3) associating the bet amount with the selected roll outcome via one of more mechanical devices;

(4) selecting the roll outcome from possible roll outcomes shown on a display, wherein at least a portion of the display contains a game table design as shown in any one of FIGS. 1–3;

(5) verifying a given selected roll outcome by responding to a prompt from the electronic device;

(6) canceling a given bet via one of more mechanical devices;

(7) rolling the dice via one of more mechanical devices up to a predetermined number of times;

(8) verifying a given selected roll outcome by responding to a prompt from the electronic device;

(9) viewing a roll history on at least a portion of the display to observe a roll history for the electronic device prior to rolling the dice;

(10) deducting a bet amount from the player's account for placing a bet;

(11) paying a player with a winning bet (i) the bet amount, and (ii) an amount of winnings based on the pay-out odds of the bet, wherein the winnings are paid in tokens or credit; and

(12) crediting a player's account with the amount of the winnings.

5. The method of claim 4, further comprising the steps of providing one of more mechanical devices comprising a buttons a keyboard, a cursor, or a touch screen pad.

6. The method of claim 4, further comprising the steps of providing on at least a portion of the display of the electronic device a balance of the player's account.

7. The method of claim 1, further comprising the steps of playing the dice game on a casino table, a board game, or an electronic device.

8. The method of claim 7, further comprising the steps of playing the dice game on a video poker-type machine, a hand-held electronic device, a device for connecting to a television, or a personal computer.

9. The method of claim 7, further comprising the steps of using a software program comprising code for playing the dice game on said electronic device.

10. The method of claim 7, further comprising the steps of using an electronic disc to store thereon a software program comprising code for playing the dice game on said electronic device.

11. The method of claim 1, wherein the step of rolling the dice comprises rolling 3 dice.

12. The method of claim 11, wherein the pay-out odds are up to about "193 to 1".

13. The method of claim 11, further comprising special rules, wherein the special rules comprise:

(1) If player A bets on a pair, no player bets on 3-of-a-kind, and 3-of-a-kind is rolled, player A wins the pair bet; and (2) If player A bets on a pair, and player B bets on 3-of-a-kind, and 3-of-a-kind is rolled, player B wins on the 3-of-a-kind bet, and player A wins the pair bet.

14. The method of claim 1, wherein the step of rolling the dice comprises rolling 4 dice.

15. The method of claim 14, wherein the pay-out odds are up to about "1165 to 1".

16. The method of claim 14, further comprising special rules, wherein the special rules comprise:

(1) If player A bets on a pair, no player bets on 2 pair, 3-of-a-kind, or 4-of-a-kind, and one of 2 pair, 3-of-a-kind, or 4-of-a-kind is rolled, player A wins the pair bet;

(2) If player A bets on a pair, and player B bets on any one of 2 pair, 3-of-a-kind, or 4-of-a-kind, and one of 2 pair, 3-of-a-kind, or 4-of-a-kind is rolled, player B wins on the 2 pair, 3-of-a-kind, or 4-of-a-kind bet, and player A wins the pair bet;

(3) If player A bets on 2 pair, no player bets on 4-of-a-kind, and 4-of-a-kind is rolled, player A wins the 2 pair bet;

(4) If player A bets on 2 pair, and player B bets on 4-of-a-kind, and 4-of-a-kind is rolled, player B wins on the 4-of-a-kind bet, and player A wins the pair bet;

(5) If player A bets on 3-of-a-kind, no player bets on 4-of-a-kind, and 4-of-a-kind is rolled, player A wins the 3-of-a-kind bet; and (6) If player A bets on 3-of-a-kind, and player B bets on 4-of-a-kind, and 4-of-a-kind is rolled, player B wins on the 4-of-a-kind bet, and player A wins the 3-of-a-kind bet.

17. The method of claim 1, wherein the step of rolling the dice comprises rolling 5 dice.

18. The method of claim 17, wherein the pay-out odds are up to about "6997 to 1".

19. The method of claim 17, further comprising special rules, wherein the special rules comprise:

(1) If player A bets on 2 pair, no player bets on a full house, 4-of-a-kind, or 5-of-a-kind, and a full house, 4-of-a-kind, or 5-of-a-kind is rolled, player A wins the 2-pair bet;

(2) If player A bets on 2 pair, and player B bets on a full house, 4-of-a-kind, or 5-of-a-kind, and a full house, 4-of-a-kind, or 5-of-a-kind is rolled, player B wins on the a full house, 4-of-a-kind, or 5-of-a-kind bet, and player A wins the 2-pair bet;

(3) If player A bets on 3-of-a-kind, no player bets on a full house, 4-of-a-kind, or 5-of-a-kind, and a full house, 4-of-a-kind, or 5-of-a-kind is rolled, player A wins the 3-of-a-kind bet;

(4) If player A bets on 3-of-a-kind, and player B bets on any one of a full house, 4-of-a-kind, or 5-of-a-kind, and a full house, 4-of-a-kind, or 5-of-a-kind is rolled, player B wins on the full house, 4-of-a-kind, or 5-of-a-kind bet, and player A win the 3-of-a-kind bet;

(5) If player A bets on a full house, no player bets on 5-of-a-kind, and a 5-of-a-kind is rolled, player A wins the full house bet;

(6) If player A bets on a full house, and player B bets on 5-of-a-kind, and 5-of-a-kind is rolled, player B wins on the 5-of-a-kind bet, and player A wins the full house bet;

(7) If player A bets on 4-of-a-kind, no player bets on 5-of-a-kind, and a 5-of-a-kind is rolled, player A wins the 4-of-a-kind bet; and (8) If player A bets on 4-of-a-kind, and player B bets on 5-of-a-kind, and 5-of-a-kind is rolled, player B wins on the 5-of-a-kind bet, and player A wins the 4-of-a-kind bet.

20. The method of claim 1, wherein the step of rolling the dice comprises rolling the dice on a game table.

21. The method of claim 1, further comprising displaying a history of the last x winning single roll outcomes.

22. A method of playing a dice game comprising the steps of:

displaying for a player's view betting areas representing all of the possible single roll combinations resulting from a single roll of from 3 to 5 dice;

placing a bet on one or more of the betting areas representing all of the possible single roll combinations resulting from a single roll of from 3 to 5 dice;

rolling one set of dice a single time wherein the set of dice contain from 3 to 5 similarly colored dice; and paying an amount of winnings to a player for a winning single roll outcome, wherein the amount of winnings is based on pay-out odds assigned to each and every possible single roll combination of the dice.

23. The method of claim 22, further comprising determining pay-out odds for each and every possible single roll combination of the dice, wherein the pay-out odds are determined using a formula below:

$$p = \frac{y(x-w)}{w}$$

wherein:

p represents a pay-out odds multiple;

y represents a desired yield to the player;

x represents a total number of the possible roll combinations; and w represents a probable number of winning bets per x rolls of the dice.

24. The method of claim 22, wherein the step of rolling one set of dice a single time comprises rolling 3 dice.

25. The method of claim 24, wherein the pay-out odds are tip to about "193 to 1".

26. The method of claim 24, further comprising special rules, wherein the special rules comprise:

(1) If player A bets on a pair, no player bets on 3-of-a-kind, and 3-of-a-kind is rolled, player A wins the pair bet; and (2) If player A bets on a pair, and player B bets on 3-of-a-kind, and 3-of-a-kind is rolled, player B wins on the 3-of-a-kind bet, and player A wins the pair bet.

27. The method of claim 22, wherein the step of rolling one set of dice a single time comprises rolling 4 dice.

28. The method of claim 27, wherein the pay-out odds are up to about "1165 to 1".

29. The method of claim 27, further comprising special rules, wherein the special rules comprise:

(1) If player A bets on a pair, no player bets on 2 pair, 3-of-a-kind, or 4-of-a-kind, and one of 2 pair, 3-of-a-kind, or 4-of-a-kind is rolled, player A wins the pair bet;

(2) If player A bets on a pair, and player B bets on any one of 2 pair, 3-of-a-kind, or 4-of-a-kind, and one of 2 pair, 3-of-a-kind, or 4-of-a-kind is rolled, player B wins on the 2 pair, 3-of-a-kind, or 4-of-a-kind bet, and player A wins the pair bet;

(3) If player A bets on 2 pair, no player bets on 4-of-a-kind, and 4-of-a-kind is rolled, player A wins the 2 pair bet;

(4) If player A bets on 2 pair, and player B bets on 4-of-a-kind, and 4-of-a-kind is rolled, player B wins on the 4-of-a-kind bet, and player A wins the pair bet;

(5) If player A bets on 3-of-a-kind, no player bets on 4-of-a-kind, and 4-of-a-kind is rolled, player A wins the 3-of-a-kind bet; and (6) If player A bets on 3-of-a-kind, and player B bets on 4-of-a-kind, and 4-of-a-kind is rolled, player B wins on the 4-of-a-kind bet, and player A wins the 3-of-a-kind bet.

30. The method of claim 22, wherein the step of rolling one set of dice a single time comprises rolling 5 dice.

31. The method of claim 30, wherein the pay-out odds are up to about "6997 to 1".

32. The method of claim 30, further comprising special rules, wherein the special rules comprise:

(1) If player A bets on 2 pair, no player bets on a full house, 4-of-a-kind, or 5-of-a-kind, and a full house, 4-of-a-kind, or 5-of-a-kind is rolled, player A wins the 2-pair bet;

(2) If player A bets on 2 pair, and player B bets on a full house, 4-of-a-kind, or 5-of-a-kind, and a full house, 4-of-a-kind, or 5-of-a-kind is rolled, player B wins on the a full house, 4-of-a-kind, or 5-of-a-kind bet, and player A wins the 2-pair bet;

(3) If player A bets on 3-of-a-kind, no player bets on a full house, 4-of-a-kind, or 5-of-a-kind, and a full house, 4-of-a-kind, or 5-of-a-kind is rolled, player A wins the 3-of-a-kind bet;

(4) If player A bets on 3-of-a-kind, and player B bets on any one of a full house, 4-of-a-kind, or 5-of-a-kind, and a full house, 4-of-a-kind, or 5-of-a-kind is rolled, player B wins on the full house, 4-of-a-kind, or 5-of-a-kind bet, and player A win the 3-of-a-kind bet;

(5) If player A bets on a full house, no player bets on 5-of-a-kind, and a 5-of-a-kind is rolled, player A wins the full house bet;

(6) If player A bets on a full house, and player B bets on 5-of-a-kind, and 5-of-a-kind is rolled, player B wins on the 5-of-a-kind bet, and player A wins the full house bet;

(7) If player A bets on 4-of-a-kind, no player bets on 5-of-a-kind, and a 5-of-a-kind is rolled, player A wins the 4-of-a-kind bet; and (8) If player A bets on 4-of-a-kind, and player B bets on 5-of-a-kind, and 5-of-a-kind is rolled, player B wins on the 5-of-a-kind bet, and player A wins the 4-of-a-kind bet.

33. The method of claim 22, wherein the step of rolling one set of dice a single time comprises rolling the dice on a game table.

34. The method of claim 22, wherein the step of rolling one set of dice a single time comprises rolling the dice on a game table having a table design as shown in any one of FIGS. 1–3.

35. The method of claim 22, further comprising displaying a history of the last x winning single roll outcomes.

36. The method of claim 22, wherein the step of rolling one set of dice a single time comprises rolling the dice on a game board having a board design as shown in any one of FIGS. 1–3.

37. The method of claim 22, wherein the step of rolling one set of dice a single time comprises initiating a roll command on an electronic device having a display, wherein at least a portion of the display comprises a game table display having a table design as shown in any one of FIGS. 1–3.

38. The method of claim 37, wherein the electronic device comprises a video poker-type machine, a hand-held electronic device, a device for connecting to a television, or a personal computer.

39. The method of claim 22, further comprising one or more steps comprising:

(1) inputting one or more coins or tokens into an electronic device;

(2) designating a bet amount via one of more mechanical devices;

(3) associating the bet amount with the selected roll outcome via one of more mechanical devices;

(4) selecting the roll outcome from possible roll outcomes shown on a display, wherein at least a portion of the display contains a game table design as shown in any one of FIGS. 1–3;

(5) verifying a given selected roll outcome by responding to a prompt from the electronic device;

(6) canceling a given bet via one of more mechanical devices;

(7) rolling the dice via one of more mechanical devices up to a predetermined number of times;

(8) verifying a given selected roll outcome by responding to a prompt from the electronic device;

(9) viewing a roll history on at least a portion of the display to observe a roll history for the electronic device prior to rolling the dice;

(10) deducting a bet amount from the player's account for placing a bet;

(11) paying a player with a winning bet (i) the bet amount, and (ii) an amount of winnings based on the pay-out odds of the bet, wherein the winnings are paid in tokens or credit; and

(12) crediting a player's account with the amount of the winnings.

40. The method of claim 39, further comprising the steps of providing one of more mechanical devices comprising a button, a keyboard, a cursor, or a touch screen pad.

41. The method of claim 39, further comprising the steps of providing on at least a portion of the display of the electronic device a balance of the player's account.

42. The method of claim 22, further comprising the steps of playing the dice game on a casino table, a board game, or an electronic device.

43. The method of claim 42, further comprising the steps of playing the dice game on a video poker-type machine, a hand-held electronic device, a device for connecting to a television, or a personal computer.

44. The method of claim 42, further comprising the steps of using a software program comprising code for playing the dice game on said electronic device.

45. The method of claim 42, further comprising the steps of using an electronic disc to store thereon a software program comprising code for playing the dice game on said electronic device.

46. The method of claim 22, further comprising one or more steps comprising:

(1) designating a bet amount;

(2) associating the bet amount with the selected roll outcome;

(3) designating a roller of the dice;

(4) placing one or more bets on one or more bet locations on a game table having a table design as shown in any one of FIGS. 1–3;

(5) removing losing bets from the game table;

(6) rolling the dice up to a predetermined number of times and then passing the dice to another roller to provide each player with an opportunity to roll the dice;

(7) requesting a casino table operator to place a given amount on a bet location of a game table;

(8) viewing a roll history display to observe a roll history for the game table prior to rolling the dice;

(9) changing a bet or an amount of a bet prior to rolling the dice;

(10) changing a bet or an amount of a bet prior to a casino table operator's announcement that all bets are final;

(11) in response to a casino table operator's announcement that all bets are final, proceeding to the dice rolling step; and

(12) paying a player with a winning bet (i) the bet amount, and (ii) an amount of winnings based on the pay-out odds of the bet, wherein the winnings is paid in casino chips.

47. The method of claim 22, further comprising one or more steps comprising:

(1) designating a bet amount;

(2) associating the bet amount with the selected roll outcome;

(3) designating a roller of the dice;

(4) providing each player with a predetermined amount of imitation money to be used on making one or more bets per roll of the dice;

(5) placing one or more bets on one or more bet locations on a game board having a board design as shown in any one of FIGS. 1–3;

(6) removing losing bets from the game board;

(7) rolling the dice up to a predetermined number of times and then passing the dice to another roller to provide each player with an opportunity to roll the dice;

(8) changing a bet or an amount of a bet prior to rolling the dice;

(9) changing a bet or an amount of a bet prior to a final instruction by a game board facilitator;

(10) in response to a game board facilitator's announcement that all bets are final, proceeding to the dice rolling step; and

(11) paying a player with a winning bet (i) the bet amount, and (ii) an amount of winnings based on the pay-out odds of the bet, wherein the winnings are paid in imitation money or tokens.

* * * * *